US006019685A

United States Patent [19]

Fonseca et al.

[11] Patent Number: 6,019,685

[45] Date of Patent: Feb. 1, 2000

[54] GOLF PUTTING PRACTICE DEVICE

[76] Inventors: Addy Fonseca; Alan Fisher, both of 12 Felix Street, Grovedale, Victoria 3216, Australia

[21] Appl. No.: 09/252,101

[22] Filed: Feb. 18, 1999

[51] Int. Cl.[7] ..... A63B 69/36

[52] U.S. Cl. ..... 473/265; 473/267

[58] Field of Search ..... 473/260, 265, 473/257, 267, 240

[56] References Cited

U.S. PATENT DOCUMENTS

| | | | |
|---|---|---|---|
| 2,992,005 | 7/1961 | Lockhart | 473/257 |
| 3,885,796 | 5/1975 | King | 473/265 |
| 3,934,874 | 1/1976 | Henderson | 473/265 |
| 5,332,211 | 7/1994 | Rife | 473/257 X |
| 5,527,041 | 6/1996 | Terry et al. | 473/265 |

*Primary Examiner*—George J. Marlo

[57] ABSTRACT

A golf putting aid device for practicing putting golf balls. The golf putting aid device includes a base plate and a pair of elongated members positioned on the base plate in parallel alignment for guiding a head of a golf putter along a linear path and wherein a cut out is formed in a periphery of the base plate, centrally of said elongated members, for resting a golf ball on a ground surface on which the base plate is adapted to be positioned. Each of the elongated members has a uniform L-shaped cross-section along a length thereof. Each angled member has a substantially planar rectangular bottom extent. The bottom extent of each elongate member is selectively adjustable along an axis perpendicular with the path to accommodate golf heads of varying widths. In an embodiment the base plate includes a plurality of slots for permitting adjustment of the elongate members.

5 Claims, 2 Drawing Sheets

GOLF PUTTING PRACTICE DEVICE

BACKGROUND OF THE INVENTION

1. Related Application

The present application is related to an application filed in Australia on Aug. 20, 1996 under serial number PO1893 and is incorporated herein by reference.

2. Field of the Invention

The present invention relates to golf practice aids and more particularly pertains to a new golf putting practice device for practicing putting golf balls.

3. Description of the Prior Art

The use of golf practice aids is known in the prior art. More specifically, golf practice aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,934,874; U.S. Pat. No. 5,294,124; U.S. Pat. No. 3,572,720; U.S. Pat. No. 3,885,796; U.S. Pat. No. 3,194,565; U.S. Pat. No. 5,131,659; and U.S. Pat. No. Des. 198,459.

In these respects, the golf putting practice device according to the present invention substantially departs from the conventional concepts and designs of the prior art, and in so doing provides an apparatus primarily developed for the purpose of practicing putting golf balls.

SUMMARY OF THE INVENTION

In view of the foregoing disadvantages inherent in the known types of golf practice aids now present in the prior art, the present invention provides a new golf putting practice device construction wherein the same can be utilized for practicing putting golf balls.

The general purpose of the present invention, which will be described subsequently in greater detail, is to provide a new golf putting practice device apparatus and method which has many of the advantages of the golf practice aids mentioned heretofore and many novel features that result in a new golf putting practice device which is not anticipated, rendered obvious, suggested, or even implied by any of the prior art golf practice aids, either alone or in any combination thereof.

To attain this, the present invention generally comprises a base plate with a substantially planar rectangular configuration having a periphery defined by a pair of elongated side edges and a pair of short end edges. The base plate has two pairs of slots including a first pair of slots formed therein in linear alignment and a first predetermined distance from a first one of the end edges of the base plate and in parallel relationship therewith. The slots further include a second pair of slots formed therein in linear alignment and a second predetermined distance from a second one of the end edges and in parallel relationship therewith. Each of the pairs of slots includes a first slot positioned adjacent to a first one of the side edges of the base plate and a second slot positioned adjacent to a second one of the side edges. The base plate further includes a substantially rectangular cut out formed in a central extent of the second end edge. The cut out is equipped with a width and a depth each about ¼ that of the end edges of the base plate. A first linear bold line is positioned on a top face of the base plate between a central extent of the first end edge and a central extent of the cut out. Associated therewith is a second linear bold line situated on the top face of the base plate in perpendicular relationship with the first linear bold line and coincident with an interior edge of the cut out. For allowing a user to view himself, the base plate preferably has a mirrored surface on the top face thereof. Next provided is a pair of elongated angled members each with a uniform L-shaped cross-section along a length thereof, as shown in FIG. 3. Each angled member has a substantially planar rectangular bottom extent with a pair of apertures formed therein for being slid and selectively fixed within the slots. As such, the angled members remain parallel with the first linear bold line and are selectively distanced therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf putting practice device apparatus and method which has many of the advantages of the golf practice aids mentioned heretofore and many novel features that result in a new golf putting practice device which is not anticipated, rendered obvious, suggested, or even implied by any of the prior art golf practice aids, either alone or in any combination thereof.

It is another object of the present invention to provide a new golf putting practice device which may be easily and efficiently manufactured and marketed.

It is a further object of the present invention to provide a new golf putting practice device which is of a durable and reliable construction.

An even further object of the present invention is to provide a new golf putting practice device which is susceptible of a low cost of manufacture with regard to both materials and labor, and which accordingly is then susceptible of low prices of sale to the consuming public, thereby making such golf putting practice device economically available to the buying public.

Still yet another object of the present invention is to provide a new golf putting practice device which provides in the apparatuses and methods of the prior art some of the advantages thereof, while simultaneously overcoming some of the disadvantages normally associated therewith.

Still another object of the present invention is to provide a new golf putting practice device for practicing putting golf balls.

Even still another object of the present invention is to provide a new golf putting practice device that includes a base plate and a pair of elongated members positioned on the base plate in parallel alignment for guiding a head of a golf putter along a linear path. The elongated members are selectively adjustable along an axis perpendicular with the path to accommodate golf heads of varying widths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
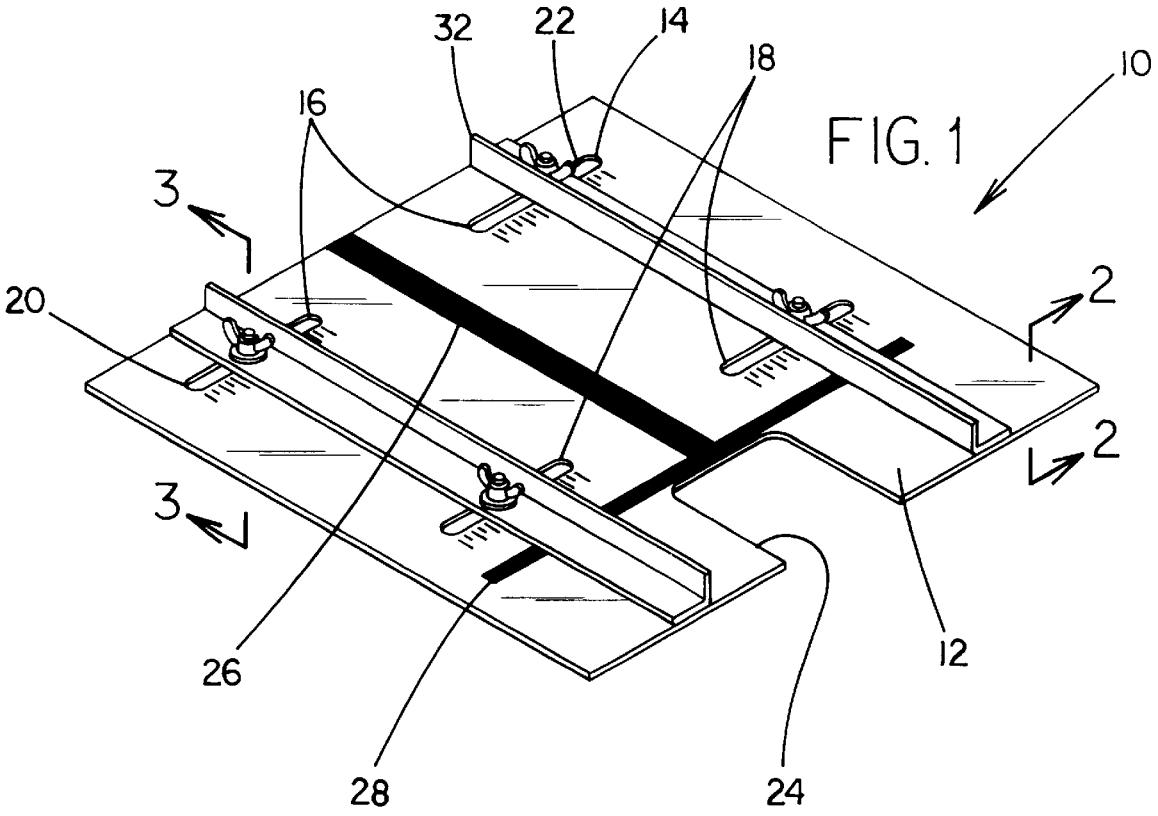
FIG. 1 is a perspective view of a new golf putting practice device according to the present invention.
Figure 2:
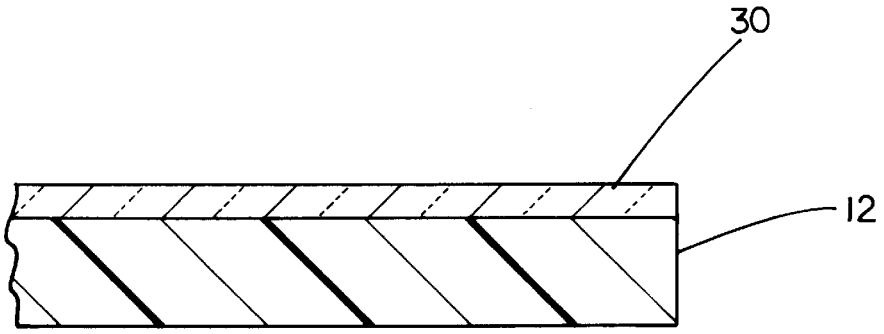
FIG. 2 is a side cross-sectional view of the present invention taken along line 2—2 shown in FIG. 1.

With reference now to the drawings, and in particular to FIGS. 1 through 4 thereof, a new golf putting practice device embodying the principles and concepts of the present invention and generally designated by the reference numeral 10 will be described.

The present invention, designated as numeral 10, includes a base plate 12 with a substantially planar rectangular configuration having a periphery defined by a pair of elongated side edges and a pair of short end edges. The base plate has two pairs of slots 14 including a first pair of slots 16 formed therein in linear alignment and a first predetermined distance from a first one of the end edges of the base plate and in parallel relationship therewith. The slots further include a second pair of slots 18 formed therein in linear alignment and a second predetermined distance from a second one of the end edges and in parallel relationship therewith. Each of the pairs of slots includes a first slot 20 positioned adjacent to a first one of the side edges of the base plate and a second slot 22 positioned adjacent to a second one of the side edges. It should be noted that the second predetermined distance is greater than the first predetermined distance.

The base plate further includes a substantially rectangular cut out 24 formed in a central extent of the second end edge. The cut out is equipped with a width and a depth each about ¼ that of the end edges of the base plate. A first linear bold line 26 is positioned on a top face of the base plate between a central extent of the first end edge and a central extent of the cut out. Associated therewith is a second linear bold line 28 situated on the top face of the base plate in perpendicular relationship with the first linear bold line and coincident with an interior edge of the cut out. For allowing a user to view himself, the base plate preferably has an acrylic mirrored surface 30 on the top face thereof.

Figure 3:
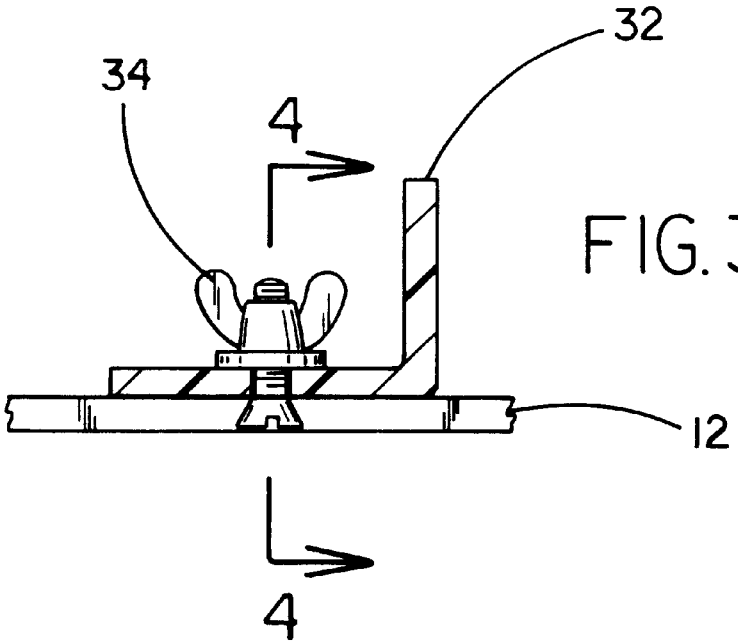
FIG. 3 is a side cross-sectional view of the present invention taken along line 3—3 shown in FIG. 1.
Figure 4:
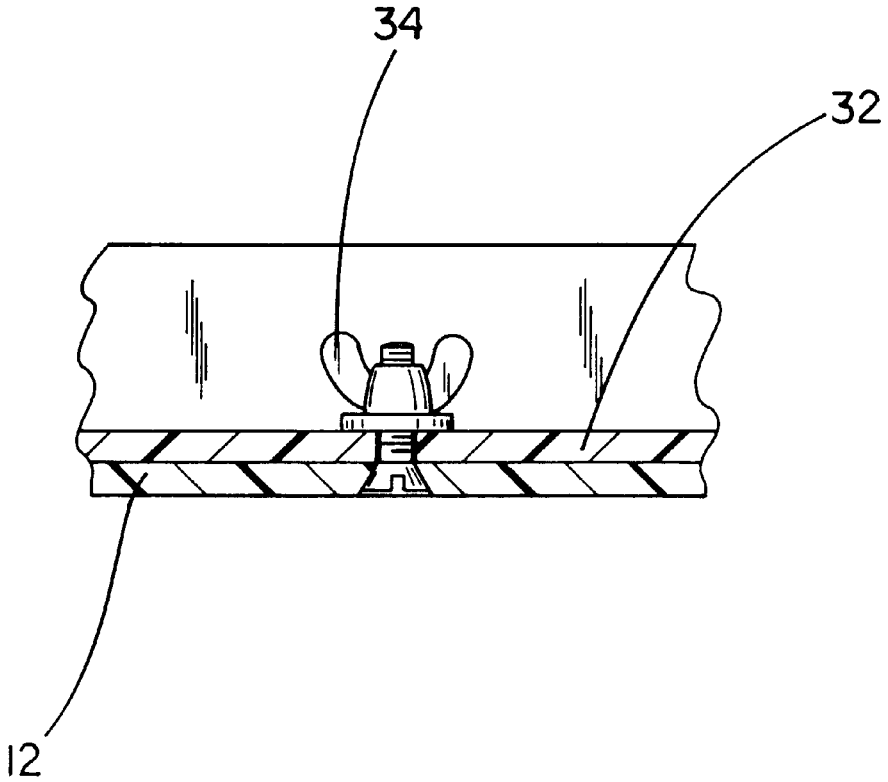
FIG. 4 is a side cross-sectional view of the present invention taken along line 4—4 shown in FIG. 3.

Next provided is a pair of elongated nylon angled members 32 each with a uniform L-shaped cross-section along a length thereof, as shown in FIG. 3. Each angled member has a substantially planar rectangular bottom extent with a pair of apertures formed therein for being slid and selectively fixed within the slots via wing nuts 34. As such, the angled members remain in parallel with the first linear bold line and are selectively distanced therefrom.

In use, a user may adjust the elongated members to conform to a size of a head of a golf putter. Thereafter, a ball may be positioned on a ground surface within the cut out. The user may thus may view himself as a putt is carried out while the elongated members serve to guide the golf putter.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf putting aid device comprising, in combination:

a base plate with a substantially planar rectangular configuration having a periphery defined by a pair of elongated side edges and a pair of short end edges, the base plate having two pairs of slots including a first pair of slots formed therein in linear alignment and a first predetermined distance from a first one of the end edges of the base plate and in parallel relationship therewith, the slots further including a second pair of slots formed therein in linear alignment and a second predetermined distance from a second one of the end edges and in parallel relationship therewith, wherein each of the pairs of slots includes a first slot positioned adjacent to a first one of the side edges of the base plate and a second slot positioned adjacent to a second one of the side edges, the base plate further including a substantially rectangular cut out formed in a central extent of the second end edge with a width and a depth each about ¼ that of the end edges of the base plate, a first linear bold line positioned on a top face of the base plate between a central extent of the first end edge and a central extent of the cut out, and a second linear bold line situated on the top face of the base plate in perpendicular relationship with the first linear bold line and coincident with an interior edge of the cut out;

said base plate having a mirrored surface on the top face thereof; and a pair of elongated angled members each with a uniform L-shaped cross-section along a length thereof, each angled member having a substantially planar rectangular bottom extent with a pair of apertures formed therein for being slid and selectively fixed within the slots such that the angled members remain parallel with the first linear bold line and are selectively distanced therefrom.

2. A golf putting aid device comprising:

a base plate; and a pair of elongated members positioned on the base plate in parallel alignment for guiding a head of a golf putter along a linear path, each of the elongated members having a uniform L-shaped cross-section along a length thereof, each angled member having a substantially planar rectangular bottom extent;

wherein the elongated members are selectively adjustable along an axis perpendicular with the path and wherein a cut out is formed in a periphery of the base plate, centrally of said elongated members, for resting a golf ball on a ground surface on which the base plate is adapted to be positioned.

3. The golf putting aid device as set forth in claim 2 wherein the base plate is substantially planar.

4. The golf putting aid device as set forth in claim 2 wherein the elongated members are adjustable within slots formed in the base plate.

5. The golf putting aid device as set forth in claim 2 wherein the base plate has a mirrored surface on the top face thereof.

* * * * *